US008714373B2

(12) United States Patent
Danehy

(10) Patent No.: US 8,714,373 B2
(45) Date of Patent: May 6, 2014

(54) STACKABLE GLIDE RACK FOR MAXIMIZING PRODUCT SELECTION

(76) Inventor: Devin Danehy, Orlando, FL (US)

( * ) Notice: Subject to any disclaimer, the term of this patent is extended or adjusted under 35 U.S.C. 154(b) by 189 days.

(21) Appl. No.: 12/886,883

(22) Filed: Sep. 21, 2010

(65) Prior Publication Data

US 2012/0067835 A1 Mar. 22, 2012

(51) Int. Cl.

| | |
|---|---|
| ***A47B 73/00*** | (2006.01) |
| *A47F 7/00* | (2006.01) |
| *A47F 1/04* | (2006.01) |
| *A47F 5/00* | (2006.01) |
| *B65D 21/00* | (2006.01) |
| *B65D 1/24* | (2006.01) |

(52) U.S. Cl.

USPC ..... 211/74; 211/49.1; 211/59.2; 211/175; 206/509; 206/821; 220/509

(58) Field of Classification Search

USPC ..... 211/59.2, 59.3, 50, 71.01, 72, 194, 175, 211/188, 126.11, 207, 49.1, 51, 74; 206/509, 511, 821; 220/509, 515

See application file for complete search history.

(56) References Cited

U.S. PATENT DOCUMENTS

| | | | | | |
|---|---|---|---|---|---|
| 3,552,817 | A | * | 1/1971 | Marcolongo | 12/107 |
| 4,724,968 | A | * | 2/1988 | Wombacher | 211/59.3 |
| 4,911,303 | A | * | 3/1990 | Andersson | 206/509 |
| D336,408 | S | * | 6/1993 | Tersch et al. | D7/619.1 |
| 5,215,199 | A | * | 6/1993 | Bejarano | 211/74 |
| 5,351,838 | A | * | 10/1994 | Flum | 211/59.2 |
| 5,366,099 | A | * | 11/1994 | Schmid | 211/59.3 |
| 5,493,107 | A | * | 2/1996 | Gupta et al. | 235/383 |
| 5,516,034 | A | * | 5/1996 | Jensen et al. | 229/120 |
| 5,624,042 | A | * | 4/1997 | Flum et al. | 211/59.2 |
| 5,634,564 | A | * | 6/1997 | Spamer et al. | 211/59.3 |
| 5,645,176 | A | * | 7/1997 | Jay | 211/59.2 |
| 5,685,664 | A | * | 11/1997 | Parham et al. | 403/393 |
| 5,775,046 | A | * | 7/1998 | Fanger et al. | 52/590.1 |
| D401,436 | S | * | 11/1998 | Jay | D6/408 |
| 5,865,323 | A | | 2/1999 | Lecroy | |
| 5,918,751 | A | * | 7/1999 | Kelly | 211/194 |
| 6,044,983 | A | | 4/2000 | Hall | |
| 6,050,657 | A | * | 4/2000 | Hiltzman | 312/111 |
| 6,135,297 | A | * | 10/2000 | DeShazo et al. | 211/74 |
| 6,227,370 | B1 | * | 5/2001 | Earnshaw et al. | 206/497 |
| 6,290,074 | B1 | * | 9/2001 | Syvuk et al. | 211/74 |
| 6,390,357 | B1 | * | 5/2002 | Ogryzlo et al. | 229/120 |
| 6,622,874 | B1 | * | 9/2003 | Hawkinson | 211/59.3 |
| 6,648,151 | B2 | | 11/2003 | Battaglia et al. | |
| 6,695,152 | B1 | * | 2/2004 | Fabrizio et al. | 211/59.2 |
| 6,715,621 | B2 | * | 4/2004 | Boron | 211/59.2 |

(Continued)

OTHER PUBLICATIONS

PCT Application, International Search Report and Written Opinion, PCT/US2011/078249.

*Primary Examiner* — Joshua J Michener
*Assistant Examiner* — Devin Barnett
(74) *Attorney, Agent, or Firm* — Jason T. Daniel, Esq.; Daniel Law Offices, P.A.

(57) ABSTRACT

A stackable glide rack includes an elongated member having a plurality of vertical partitions forming at least one row for storing a plurality of beverage containers, multiple protrusions and indentations for allowing a group of individual glide racks to be stacked in a vertical manner and an identification unit for identifying a type of beverage container stored in each row. When so oriented, a plurality of glide racks can provide an increased product selection choices without occupying additional space in a refrigerated display case.

8 Claims, 7 Drawing Sheets

(56) References Cited

U.S. PATENT DOCUMENTS

| | | | | |
|---|---|---|---|---|
| 6,722,509 | B1 * | 4/2004 | Robertson et al. | 211/59.2 |
| 6,779,670 | B2 * | 8/2004 | Primiano et al. | 211/74 |
| 6,811,042 | B2 * | 11/2004 | Kelly et al. | 211/74 |
| 7,104,410 | B2 * | 9/2006 | Primiano | 211/59.2 |
| 7,124,898 | B2 * | 10/2006 | Richter et al. | 211/59.3 |
| 7,448,504 | B2 | 11/2008 | Primiano | |
| 7,681,743 | B2 * | 3/2010 | Hanretty et al. | 211/59.2 |
| D627,612 | S * | 11/2010 | Falk et al. | D7/708 |
| 7,857,148 | B2 * | 12/2010 | Roeske | 211/59.3 |
| 8,016,139 | B2 * | 9/2011 | Hanners et al. | 211/184 |
| 2004/0026346 | A1 * | 2/2004 | Kelly et al. | 211/74 |
| 2005/0103674 | A1 * | 5/2005 | Matheou | 206/503 |
| 2005/0189310 | A1 * | 9/2005 | Richter et al. | 211/59.3 |
| 2006/0037924 | A1 * | 2/2006 | Palmisano | 211/194 |
| 2007/0039908 | A1 * | 2/2007 | Bergdoll | 211/59.3 |
| 2007/0075028 | A1 * | 4/2007 | Nagel et al. | 211/59.2 |
| 2007/0206324 | A1 * | 9/2007 | Donnell et al. | 360/133 |
| 2009/0120886 | A1 * | 5/2009 | Weiss et al. | 211/74 |

* cited by examiner

STACKABLE GLIDE RACK FOR MAXIMIZING PRODUCT SELECTION

BACKGROUND

1. Field of the Invention

The present invention relates generally to a shelf device for a refrigerated beverage display case and more particularly to a space saving glide rack for allowing increased product choices and to optimize inventory.

2. Description of the Related Art

Refrigerated display cases (also called coolers) for beverage containers typically include a plurality of shelves having a series of racks, upon which beverage containers are loaded and displayed for sale. The beverage containers may be cans or bottles of any size and the width of the glide racks are adjusted to accommodate each particular type of container.

As shown in FIG. 1, a conventional rack 10 is designed to rest on a shelf 18 and position multiple upright beverage containers 11 into uniform rows 12-17. However, as only the first beverage container in each row is accessible to a consumer, it is not possible to stock different products in the same row. Moreover, as different beverages are consumed at different rates, a situation can occur in which one row contains enough product for a week's worth of sales, and an adjacent row only contains enough product for a single day.

This inefficient use of the available cooler space prevents retailers from maximizing the space in their display cases and reduces the number of products they can offer, thus reducing potential profits.

Accordingly, the need exists for a glide rack capable of allowing an increased number of different beverage containers to be accessible by a consumer without occupying additional space in the display case.

SUMMARY OF THE INVENTION

The present invention is directed to an apparatus, system and method for maximizing product selection utilizing a stackable glide rack. One embodiment of the present invention can include an elongated member having a plurality of vertical partitions forming at least one row for storing a plurality of beverage containers. Additionally, the apparatus can include protrusions and indentations for allowing multiple glide racks to be stacked in a vertical manner and an identification unit for identifying a type of beverage container stored in each row.

Another embodiment of the present invention can include multiple glide racks configured to provide an increased product selection choices without occupying additional space in a refrigerated display case.

BRIEF DESCRIPTION OF THE DRAWINGS

Presently preferred embodiments are shown in the drawings. It should be appreciated, however, that the invention is not limited to the precise arrangements and instrumentalities shown.

FIG. **6*a*** is a front view of a stackable glide rack system according to one embodiment of the invention.

Figure 7:
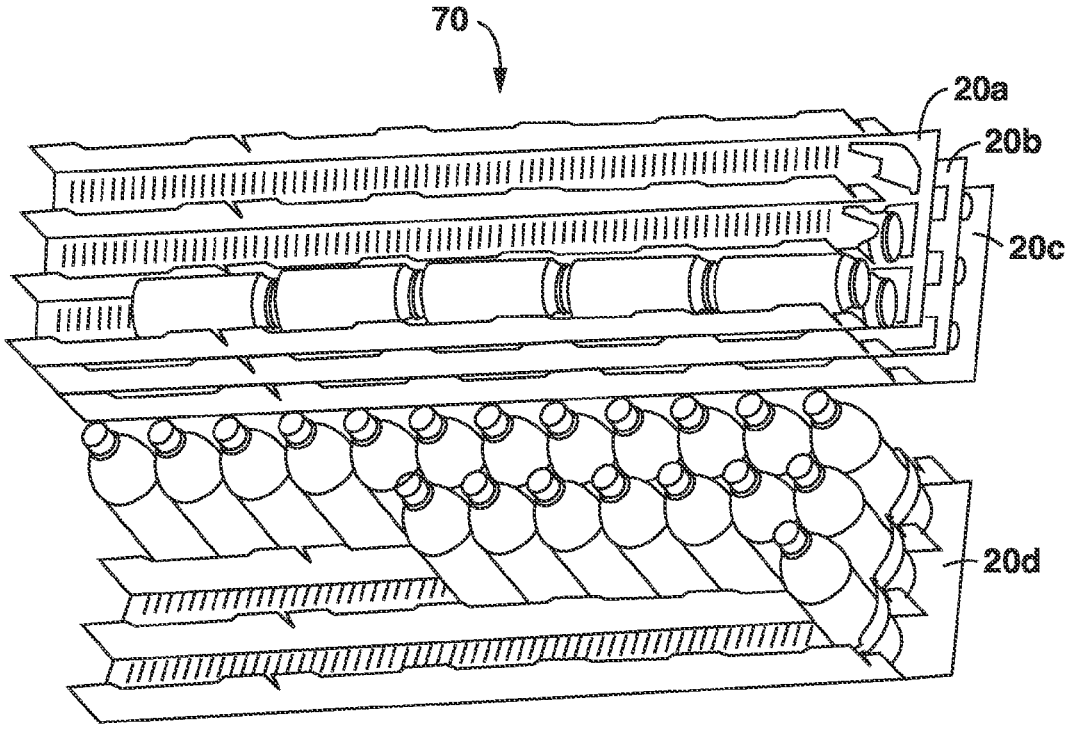

FIG. 7 is a perspective view of a stackable glide rack system according to another embodiment of the invention.

Figure 8:
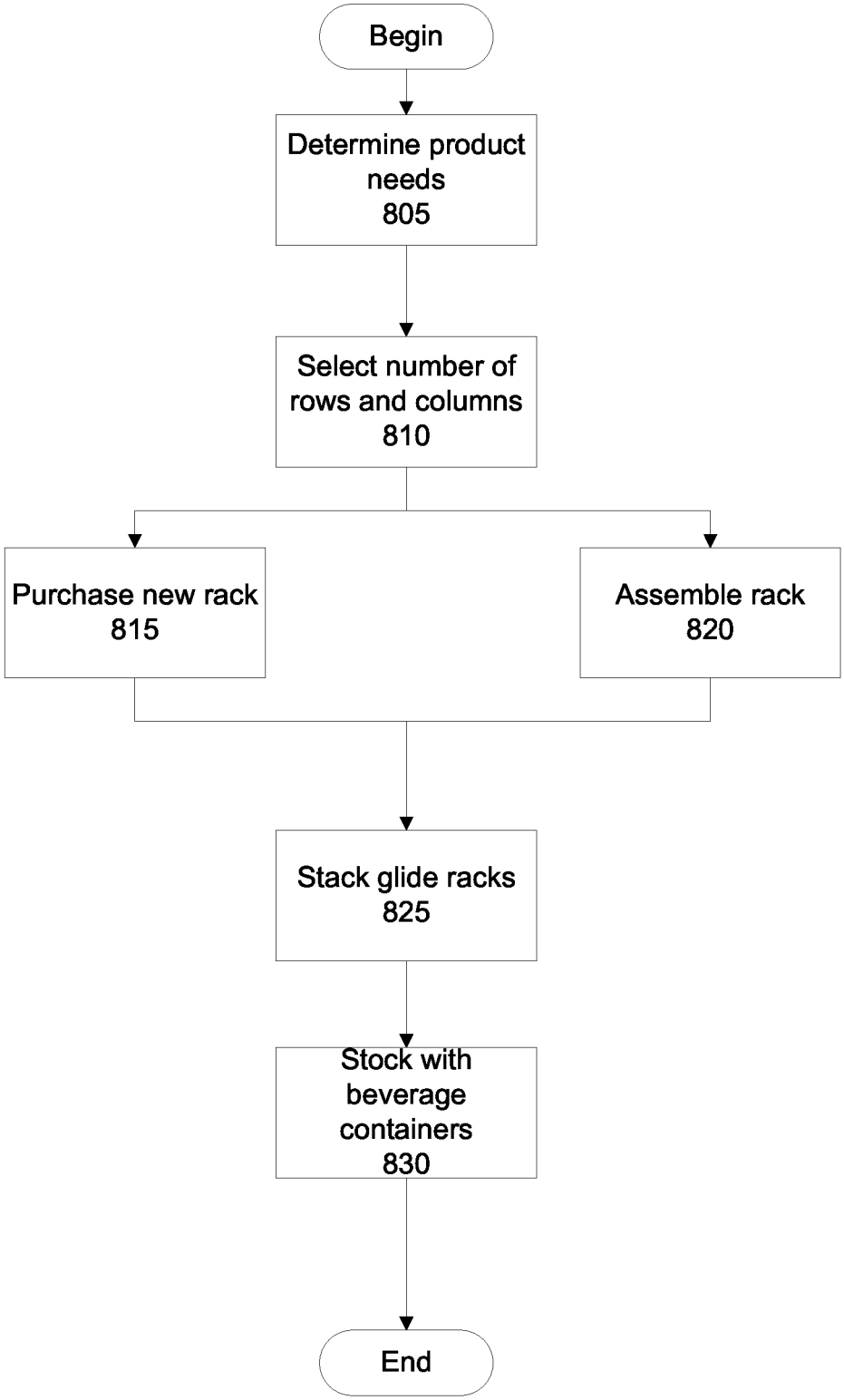

FIG. 8 is a flow chart illustrating a method for maximizing product selection in accordance with the present invention.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention. Although described throughout this document as used for beverage containers, this is but one preferred use for the inventive concepts disclosed herein. Accordingly, any number of different products, materials and/or items can be substituted for beverage containers without deviating from the scope of this invention.

Although described for use within a refrigerated display case, the inventive concepts disclosed herein can be equally applied to a traditional non-refrigerated display and/or store shelf without deviating from the scope and spirit of the invention. Such shelves including gravity feed shelves are well known in the art.

As described above, a typical refrigerated display case utilizes a shelf with racks for positioning a plurality of beverage containers in an upright position in which only the first beverage is available to be withdrawn by a consumer. Through extensive study and analysis, the inventor has created an apparatus for storing and displaying beverage containers which greatly increases the number of choices available to a consumer without taking additional space in the refrigerated display case.

Figure 1:
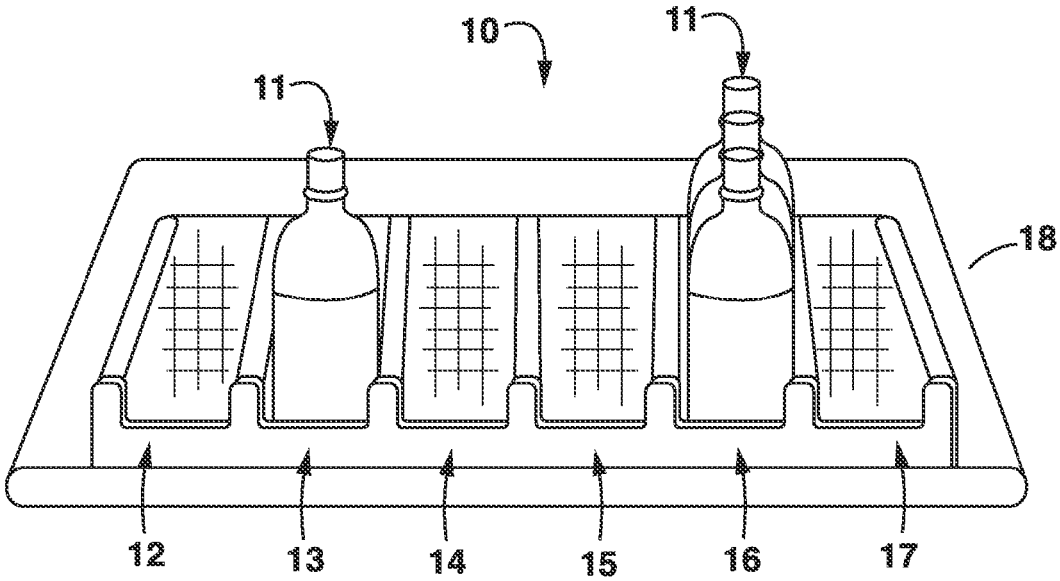
FIG. 1 Prior Art
FIG. 1 is a front view of a glide rack according to the background art.
Figure 2:
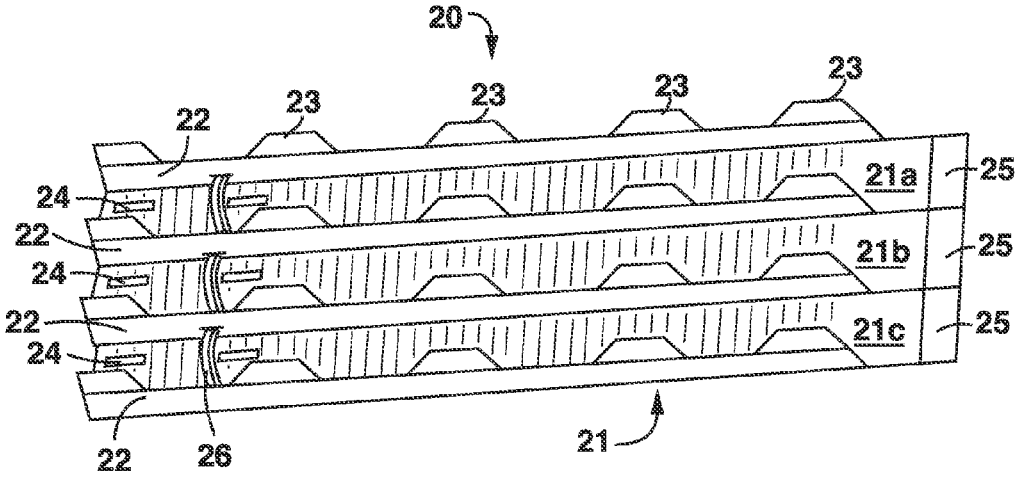
FIG. 2 is one illustration of a stackable glide rack that is useful for understanding the inventive concepts disclosed herein.

FIG. 2 illustrates one embodiment of a stackable glide rack for maximizing product selection that is useful for understanding the inventive concepts disclosed herein. To this end, stackable glide rack 20 can include a bottom portion 21 having a series of vertical partitions 22 running the length thereof to form individual rows **21*a*-21*c*. Each of rows 21*a*-21*c* can be constructed to have a height and width specific to a particular type of beverage container (such as a standard 24 ounce bottle of soda or a 16 ounce can of soda, for example) and can further include several openings 24** in order to reduce weight and to prevent moisture form accumulating within the rows. With regard to the height of the rows, it is preferred that the vertical partitions be taller than the width of the beverage container they will hold in order to allow the container to rest on its side and be easily removed from the rack.

Additionally, the stackable glide rack 20 can further include a series of upward facing protrusions 23 positioned along each vertical partition, a product identifier 25 positioned at the forward end of the glide rack and an optional pusher 26 for ensuring that a beverage container is always located at the front of the glide rack. Pusher mechanism's and their corresponding hardware being extremely well known in the art, no further description will be provided.

Figure 3:
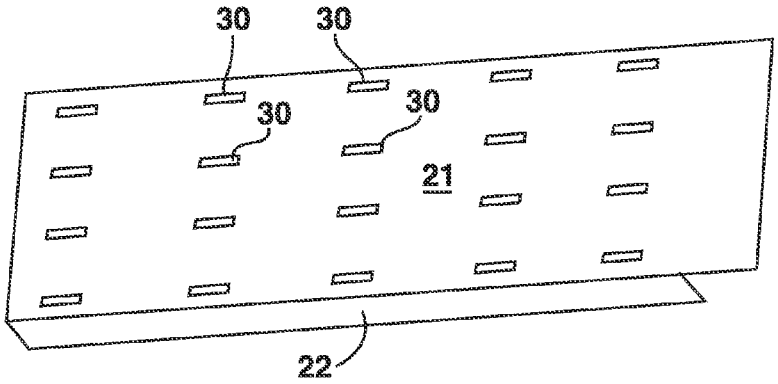
FIG. 3 is a bottom view of a stackable glide rack according to one embodiment of the invention.

FIG. 3 illustrates one embodiment of the bottom side a stackable glide rack 20. As shown, bottom portion 21 can include a plurality of indentations 30 each having a shape and dimension approximating that of the protrusions 23.

Figure 4:
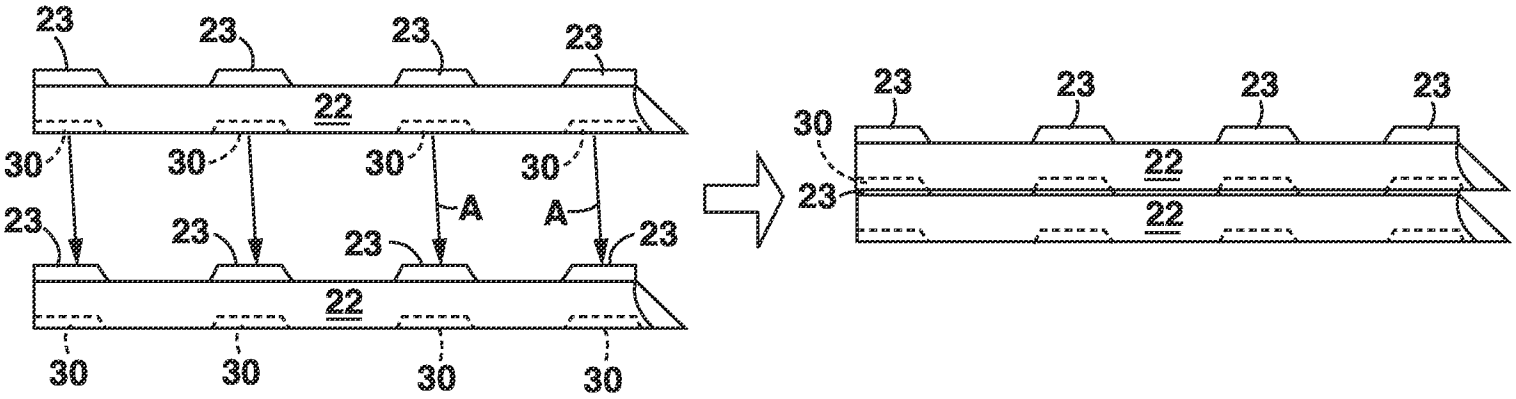
FIG. 4 is a side by side view of a stackable glide rack according to another embodiment of the invention.

Accordingly, and as illustrated in FIG. 4, each of the plurality of protrusions 23 can be positioned to directly align with and lock into the indentations 30 of another glide rack in order to form a vertical column having multiple racks securely stacked together (see arrow A).

In this way, it becomes possible to utilize the vertical space that an upright beverage container would ordinarily utilize to position a column of multiple glide racks each containing a different type of beverage container. For example, a single conventional rack capable of housing twelve beverage containers (in this instance soda bottles) in an upright manner can be replaced with a column of up to three stackable glide racks, each containing four beverage containers of a different variety. As such, although the overall number of beverage containers (twelve) does not change, it now becomes possible to carry up to three times the variety in the same amount of space.

As described herein, one or more elements of the glide rack 20 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the bottom portion 21, the vertical partitions 22, protrusions 23 and/or product identifier 25, for example, may be formed together as one continuous element, either through manufacturing processes, such as welding, casting, or molding, or through the use of a singular piece of material milled or machined with the aforementioned components forming identifiable sections thereof. Accordingly, in one preferred embodiment, each element of the glide rack 20 can be constructed from injection molded plastic and have a dimension specific to the type of beverage container to which it will hold, however other materials such as metal and rigid plastic are also contemplated.

Although described above is including three horizontal rows, the invention is not limited to this configuration. For instance, a stackable glide rack 20 according to the inventive concepts disclosed herein can be constructed to include any number of individual rows, each having a width, length and height specific to a particular type of beverage container such as, for example cans, bottles and gallon jugs, among others.

Figure 5:
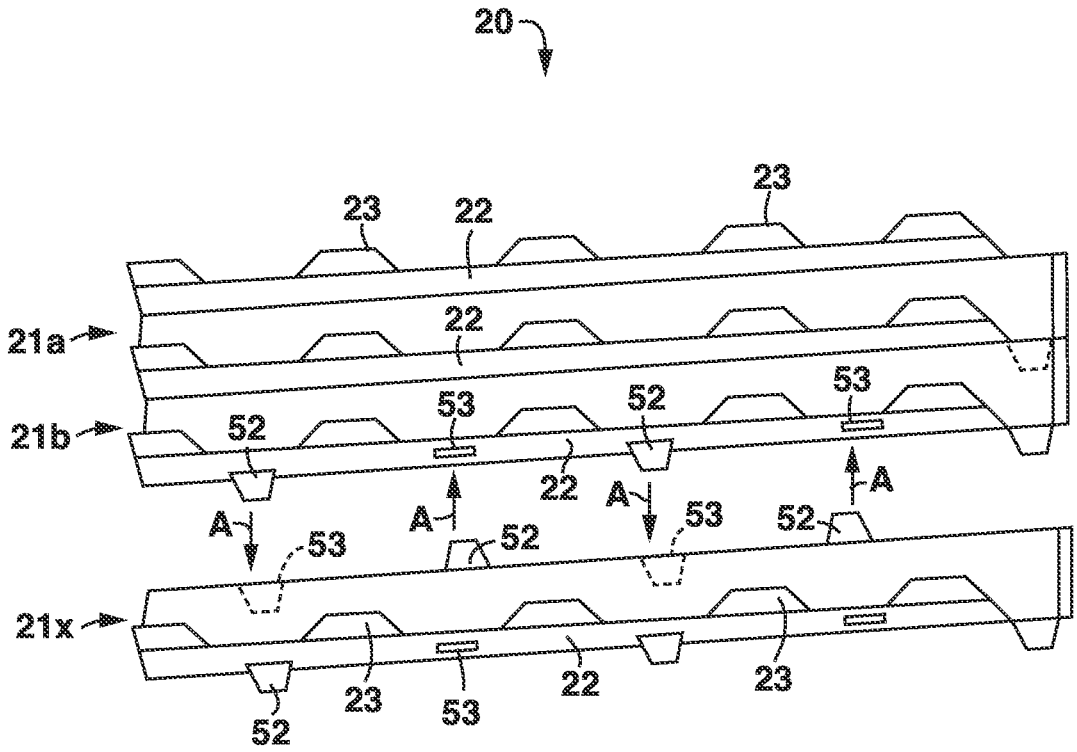
FIG. 5 is a perspective view of a stackable glide rack according to another embodiment of the invention.

FIG. 5 illustrates an alternate embodiment of a glide rack 20 that allows a user to adjust the number of horizontal rows in each rack. As shown, each individual row 21*a*-21*x* can include a plurality of horizontal protrusions 52 and openings 53 strategically positioned along the sides of each row. To this end, and as illustrated by arrow A, additional rows can be added by inserting the protrusions 52 of one row into the openings 53 of another row. Such a feature is beneficial in order to allow a glide rack 20 to be custom fit into the varying sizes and available spaces of an existing refrigerated display case.

Although described above as including a series of protrusions and openings, one of skill in the art will recognize that individual row segments can be joined using any known methodology and hardware such as tongue and grove connections and compression fittings such as a latches or pegs among many others. Accordingly, the inventive concepts are not to be construed as limiting in this regard.

Figure 6:
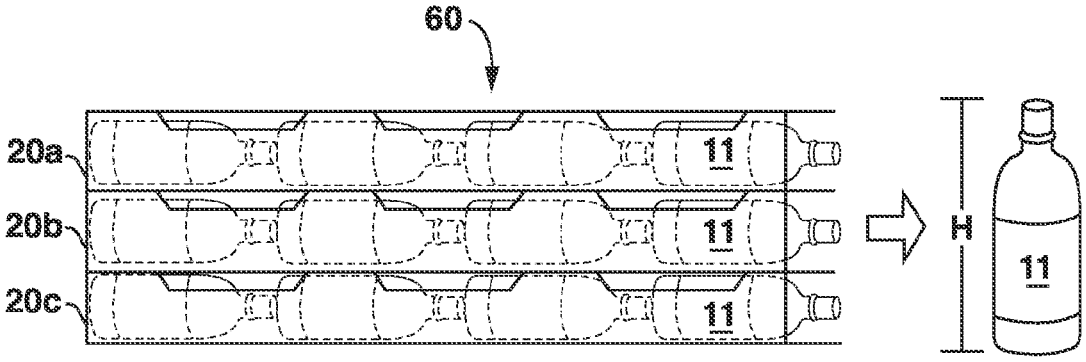
FIG. 6 is a side view of a stackable glide rack system according to one embodiment of the invention.
Figure 6A:
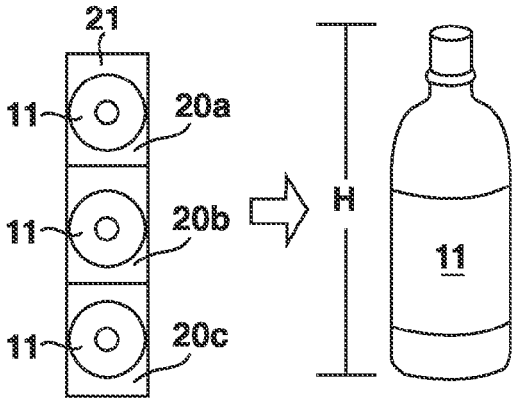

FIGS. 6 and 6*a* illustrate one embodiment of a glide rack system 60 utilizing a plurality of stackable glide racks 20 as described above.

As shown, system 60 can include a column having 3 stackable glide racks 20*a*-20*c* each having a single row 21 for securely positioning a plurality of beverage containers 11 in a horizontal position. In this regard, the overall height H of the stacked glide racks (including the beverage containers) can be the same as the height H of a single beverage container standing upright. Accordingly, by replacing a single row of traditional upright beverage containers (in which only one beverage choice is available) with the system described above, it becomes possible to increase the number of beverage choices without taking up additional space or increasing overall inventory.

FIG. 7 illustrates another embodiment of a glide rack system 70 in which a plurality of glide racks 20*a*-20*d* can be joined to house a variety of different beverage containers in both an upright and horizontal configuration.

As shown, glide racks 20*a*-20*c* can be stacked to house a number of different beverage choices in a horizontal manner. Each of these choices can include, for example, new products or lower selling products which do not require significant inventory. Moreover, glide rack 20*d* can be joined to glide racks 20*a*-20*c* and can house a plurality of beverage containers in an upright position. Each of these beverage containers can include, for example, products which require high inventory.

Accordingly, by utilizing the inventive concepts disclosed herein, a user can offer an increased number of beverage choices in an existing refrigerated display case without increasing the overall inventory.

FIG. 8 is a flow chart illustrating a method for maximizing product selection utilizing the stackable glide rack and system described above.

The method can begin at step 805 in which a user can analyze the current sales trends and inventory management to determine their product needs.

In step 810, the user can determine how many individual rows and columns a stackable glide rack can include, based on the width of a shelf inside the refrigerated display case. Next, the method can proceed to step 815, in which the user can purchase a pre-fabricated glide rack having the desired number of rows and columns, or the method can proceed to step 820 in which the user can assemble a series of individual racks to form the desired number.

In step 825, the user can join and stack a series of glide racks together based on the available space of the shelf.

Finally, in step 830, the user can load the glide racks with desired beverage containers.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A stackable retail display glide rack for maximizing selection of predetermined beverage containers within a beverage display case, the predetermined beverage containers each having a height and width, said glide rack comprising:

a plurality of elongated generally planar base members each having a top surface, a bottom surface, a length, a width, a front end, a rear end, a first side and a second side, each bottom surface including a plurality of uniformly spaced indentations extending along the length of a corresponding base member, wherein a generally planar vertical partition is connected to the first side of each base member and extends substantially along the entire length of each base member at a perpendicular angle;

wherein each vertical partition has a top end, an inner surface and an outer surface, wherein the outer surface of each vertical partition comprises a plurality of first horizontal protrusions and a plurality of first openings, wherein the plurality of first horizontal protrusions are uniformly spaced along the length of each vertical partition and a corresponding individual first opening from said plurality of first openings is formed in the outer surface of each vertical partition between each adjacent pair of first horizontal protrusions in an alternating manner;

wherein the second side of each base member comprises a plurality of second horizontal protrusions and a plurality of second openings, wherein the plurality of second openings are uniformly spaced along the length of each second side and a corresponding individual second protrusion from said plurality of second protrusions extends from the second side of each base member between each adjacent pair of second openings in an alternating manner;

wherein when in use, the second horizontal protrusions of one base member matingly engages corresponding first openings on an adjacent base member and the first horizontal protrusions of said one base member matingly engages second openings in another adjacent base member so that the respective base members are interconnected;

wherein the corresponding adjacent vertical partitions of the respective interconnected base members form individual rows between each adjacent pair of vertical partitions;

each of the individual rows including an open top end, a height and a width that approximates the width of one of the predetermined beverage containers, and further includes an open front end that is configured to receive and dispense a plurality of the predetermined beverage containers in each of a horizontal manner and a vertical manner;

wherein a plurality of vertical protrusions extend upwardly from the top end of each of the vertical partitions, each of said vertical protrusions including a shape and dimension that corresponds to the indentations of each base member so that, when in use, respective vertical protrusions and respective indentations of corresponding base members are removably connected in order to allow each of the rows to be stacked into a vertical column, thereby increasing the number of rows in the glide rack and enabling additional beverages to be stored therein.

2. The stackable glide rack of claim 1, wherein each row includes a pusher configured to move the beverage containers to the front end of each row.

3. The stackable glide rack of claim 1, wherein the stackable glide rack includes a shape and dimension suitable for use on an inclined retail gravity feed shelf.

4. The stackable glide rack of claim 1, wherein each of said base members, vertical partitions and vertical protrusions are constructed from a single material that was molded at a time of construction.

5. The glide rack of claim 1, wherein each of the vertical partitions have an identical height.

6. The glide rack of claim 1, wherein one of the predetermined beverage containers includes a conventional sized 16 ounce can.

7. The glide rack of claim 1, wherein one of the predetermined beverage containers includes a 24 ounce bottle.

8. The glide rack of claim 1, further comprising an identification unit positioned along the front end of each of the rows, said identification unit being configured to identify a type of predetermined beverage container stored in a particular row.

* * * * *